US010542771B2

(12) United States Patent
Hong et al.

(10) Patent No.: US 10,542,771 B2
(45) Date of Patent: Jan. 28, 2020

(54) METHOD FOR PREPARING EXPANDED TOBACCO STEMS

(71) Applicant: GUANGDONG GOLDEN LEAF TECHNOLOGY DEVELOPMENT CO., LTD., Shantou (CN)

(72) Inventors: Xuehui Hong, Shantou (CN); Xiangchun Gu, Shantou (CN)

(73) Assignee: GUANGDONG GOLDEN LEAF TECHNOLOGY DEVELOPMENT CO., LTD., Shanghai (CN)

( * ) Notice: Subject to any disclaimer, the term of this patent is extended or adjusted under 35 U.S.C. 154(b) by 758 days.

(21) Appl. No.: 14/771,927

(22) PCT Filed: Sep. 24, 2013

(86) PCT No.: PCT/CN2013/084068

§ 371 (c)(1),
(2) Date: Sep. 1, 2015

(87) PCT Pub. No.: WO2014/131280

PCT Pub. Date: Sep. 4, 2014

(65) Prior Publication Data

US 2016/0007646 A1 Jan. 14, 2016

(30) Foreign Application Priority Data

Mar. 1, 2013 (CN) ..... 2013 1 0065001

(51) Int. Cl.
*A24B 15/18* (2006.01)
*A24B 3/18* (2006.01)
*A24B 15/22* (2006.01)

(52) U.S. Cl.
CPC ..... *A24B 15/18* (2013.01); *A24B 3/182* (2013.01); *A24B 15/22* (2013.01)

(58) Field of Classification Search
None
See application file for complete search history.

(56) References Cited

U.S. PATENT DOCUMENTS 3,500,834 A * 3/1970 Miller ..... A24B 3/185 131/290
3,734,104 A 5/1973 Buchanan et al.
(Continued)

FOREIGN PATENT DOCUMENTS

CN 2607033 Y 3/2004
CN 1233283 C * 12/2005
(Continued)

OTHER PUBLICATIONS

Extended European Search Report of Corresponding International Application No. PCT/CN2013/084068 dated Mar. 16, 2016.
(Continued)

*Primary Examiner* — Phu H Nguyen
(74) *Attorney, Agent, or Firm* — Philip E. Levy; Eckert Seamans Cherin & Mellott, LLC

(57) ABSTRACT

This invention relates to a method for preparing expanded tobacco stems, characterized in that the method contains steps as follows: purification, stem expansion, hypoxia heat retention (hypoxia heat retention refers to heating the expanded stems at hypoxia environment and maintaining the temperature), natural stacking, sorting, and packaging. An expanded tobacco stem product prepared according to this method has uniform size and color. Taste is modest and plain when it is combusted, which does not affect the original taste flavour. Expansion volume, the ratio of the expanded stems to the total stems, and quality are stable, which can be used as adsorption material. More important, expanded tobacco stems made from stems of different origin, texture and year according to this method have uniform odor component,
(Continued)

which can not be acquired by other expansion technologies. This technology has met the requirement for product fabrication.

7 Claims, 2 Drawing Sheets

(56) References Cited

U.S. PATENT DOCUMENTS 4,167,191 A * 9/1979 Jewell ..... A24B 3/04 131/296
4,235,249 A 11/1980 Psaras et al.

FOREIGN PATENT DOCUMENTS

CN 101214086 A 7/2008
CN 102613687 A 8/2012
CN 102613687 A 8/2012
CN 103169150 A 6/2013
WO 2012085198 A1 6/2012

OTHER PUBLICATIONS

An Office Action issued by the State Intellectual Property Office of the P.R. China dated Jul. 3, 2014 for Chinese priority application No. 201310065001.X.
An International Search Report and Written Opinion issued by the State Intellectual Property Office of the P.R. China dated Dec. 22, 2013 for International Patent Application No. PCT/CN2013/084068.
First Search of Chinese Priority Application No. 20130065001X, dated Jun. 25, 2014.
Office Action of Chinese Priority Application No. 20130065001.X, dated Jul. 3, 2014.
Notification to Grant Patent Right for Invention of of Chinese Priority Application No. 20130065001.X, dated Sep. 15, 2014.

* cited by examiner a b

METHOD FOR PREPARING EXPANDED TOBACCO STEMS

CROSS-REFERENCE TO RELATED APPLICATIONS

This application is the U.S. national stage of PCT/CN2013/084068 filed Sep. 24, 2013, which claims priority from Chinese application 201310065001.X filed Mar. 1, 2013, both of which are hereby incorporated by reference.

BACKGROUND OF THE INVENTION

The present invention relates to material for cigarettes and a preparation method thereof, more particularly, to expanded stem fillers and a method for preparing the same, with the expanded stem fillers having modest and plain features, low content of flavor components, a uniform brown color and uniform expansion volume.

Tobacco stems, accounting for around 20% of weight of tobacco leafs, have chemical components basically same as leafs, but less contents of chemical components than leafs. Stem shreds converted from stems have low filling power, insufficient aroma, high irritation, low strength and strong wood taste. Researches and practices show that the above mentioned defects can be resolved through stem expansion, which means that expanded stems can be added into cigarette products in a large proportion, for enriching cigarette varieties and improving cigarette output.

As of yet, a lot of researches have been done on tobacco stem expansion by domestic and overseas enterprise research institutes.

Chinese patent CN 1759768A discloses a method for preparing reconstituted tobacco by a paper making process. This method utilizes low tier raw tobacco to manufacture reconstituted tobacco by using the paper making process. Because of the use of low tier raw tobacco, the final product has relatively strong irritation, offensive taste and wood taste.

Chinese patent CN 1748586A discloses a method and device for processing expanded stems. This method utilizes high-temperature steam and venturi mechanism for stem expansion and then cuts stems into shreds, and finally the expanded stems with relatively higher filling power are obtained. This method is of high cost, since the processing and equipment are complicated and the operational condition is severe. During the rapid pressurizing process with high-temperature and high-pressure steam, lattice of stem cells and stem epidermis are destroyed, which degrades stems.

Chinese Patent CN 1698481A and CN 1518906A disclose a method of preparing expansion stems and a method of preparing shreds. This method utilizes microwave for expansion after heating solid medium is mixed with stems. Even though this method is able to provide a higher ratio of expanded stems to total feeding stems, the solid medium heating system and the device for separating stems from medium are complicated and costly, and furthermore stems are contaminated, and environmental pollution is produced.

Chinese patent CN 101214086A discloses a method and equipment for pre-treating stems. The method utilizes heating air medium to pre-heat stems and then utilizes microwave for expansion to acquire expanded stems. When the heating air medium and stems are mixed and then fed into a microwave expansion chamber, the heating air medium temperature and the pre-heated stem temperature are dropped to a certain degree. During the microwave expansion process, the surface temperature of stems is low, which leads to a low ratio of expanded stems to the total feeding stems. If it is intended that temperature of the heating air medium and the stem surface is ensured during the expansion process, the temperature of the heating air medium is needed to be raised during the pre-heating phase, but the over-heated air will scorch the stem surface during the pre-heating phase, which might lead to spark phenomenon during the microwave process.

Chinese patent CN 1973699A discloses a method and device for using saturated or super-heated steam to continuously perform stem expansion. This method utilizes high-temperature steam for stem expansion. But because energy provided by steam is not enough, and furthermore the heating process is achieved by the way of heat transfer and the heat is transferred from outside to inside, therefore the ratio of expanded stems to the total feeding stems is not high and the color change of the stem surface is tremendous.

The above mentioned method as well as expanded stems or shreds prepared by the method are with some deficiencies: negative tastes like green gas and wood taste are found when the prepared stems are combusted, which impacts flavor and raw taste of cigarettes when introduced in cigarette blend; there is no uniform standard for final products, and the standard is defined by individual cigarette manufacturer; final product qualities (organ sensory, appearance) vary a lot, if the final products are produced from stems of different origins, different qualities and different batches. Because of deficiencies stated above, products of expanded stems are not put in place for being a commercial product traded on the market, which restrains large-scale application of stems. Market shows urgent demand for stem filler for cigarettes with modest, plain taste when combusted, low content of flavor components, uniform color and consistent expansion volume.

SUMMARY OF THE INVENTION

Figure 1:
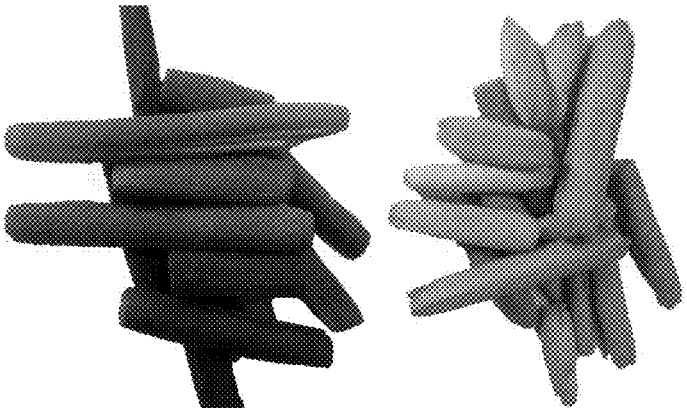
FIG. 1 is an appearance and color comparison view between expanded stems of the present invention and the expanded stems in the prior art.

In one aspect the invention comprises a method for preparing expanded stems, comprising a. purification, wherein impurities in the stems are eliminated; b. stem expansion, wherein the stems are expanded until volume of the stems is more than 180% of the original volume; c. hypoxia heat retention, wherein the expanded stems are heated to the temperature of 120~350° C. under hypoxia environment and the temperature is maintained; d. natural stacking, wherein the expanded stems after the hypoxia heat retention are stacked under natural environment for 10 days to 3 months; e. sorting, wherein the expanded stems are sorted by different size; and g. packaging, wherein the sorted expanded stems are categorized and packaged by different size separately, resulting in a final product of expanded stems. In another aspect the invention comprises the resulting expanded tobacco stem.

DETAILED DESCRIPTION OF INVENTION

Technical Question to be Solved

One object of the present invention is to provide a method for preparing expanded tobacco stems.

The other object of the present invention is to provide expanded tobacco stems prepared according to the mentioned-above method.

The present invention aims to solve the deficiencies of existing stem products and provide expanded stems, expanded stem fillers for cigarettes, and its preparation method. The expanded stems according to the invention have uniform size and color, and modest and plain taste that does not affect the original flavor of cigarettes, and are tradable on the market. The present invention is achieved by the following technical solution.

The present invention relates to a method for preparing expanded stems. The steps of the method are as follows:

a. purification, wherein impurities in stems, such as scrap iron, dirt, sand and dust in the tobacco stems, are eliminated;
b. stem expansion, wherein stems are expanded until the volume thereof is 180% of the original volume;
c. hypoxia heat retention, wherein the expanded stems are heated to 120~350° C. under hypoxia environment, and the temperature is maintained;
d. natural stacking, wherein the expanded stems after the treatment of hypoxia heat retention are stacked under natural environment for 10 days to 3 months;
e. sorting, wherein the expanded stems are sorted by size;
f. packaging, wherein the sorted tobacco stems are packaged by size, so as to obtain final products of expanded stems.

According to a preferred embodiment of the present invention, expanded stems can be used to prepare stem fillers for cigarettes, such as stem shreds, stem strips and shives.

According to another preferred embodiment of the present invention, inert gas or super-heated steam is utilized for heating and insulation during the phase of hypoxia heat retention.

According to another preferred embodiment of the present invention, in the step of hypoxia heat retention, the heat preservation time is from 30 minutes to 20 hours.

According to another preferred embodiment of the present invention, in the step of hypoxia heat retention, the heat preservation time is from 3-15 hours.

According to another preferred embodiment of the present invention, during the phase of natural stacking, final products are cased or bagged and then stacked in shady, cool, ventilated, rain-proof, and moisture-proof environment for 10 days to 3 months.

According to another preferred embodiment of the present invention, during the phase of natural stacking, final products are cased or bagged and then stacked in shady, cool, ventilated, rain-proof, and moisture-proof environment for 25 days to 3 months.

According to another preferred embodiment of the present invention, during the sorting step, expanded stems are sorted and categorized by appearance and size.

The present invention also relates to the expanded tobacco stems obtained according to any of above-mentioned preparation methods. When combusted, the expanded tobacco stems have modest and plain taste without distinct green gas and wood taste that tobacco stems originally have, with uniform brown color, and consistent expansion volume.

The content below is the detailed description of the method for preparing expanded stems.

Stem raw material with impurities eliminated is processed by existing stem expansion technologies, such as super-heated steam or microwave, and the expansion ratio is between 180% and 500%, preferably between 180% and 300%. Then expanded stems are fed in hypoxia environment, and the existing technology of super-heated steam or other inert gas is utilized for heating the stems to 120-350° C. with the temperature being maintained for 30 minutes to 20 hours, preferably between 150~300° C. and for 3-15 hours. At this time, green gas, wood taste and some other offensive taste are volatilized under high-temperature and hypoxia environment and brought out along with super-heated steam or other inert gas. Color of expanded stems turns to be brown and uniform. And part of the stems that have not been expanded during the foregoing expansion phase is expanded here further. Expanded stems are cased or bagged when cooled down and then stacked in shady, cool, ventilated, rain-proof, and moisture-proof environment for 10 days to 3 months, preferably from 25 days to 3 months. At this moment, offensive taste in expanded stems is volatilized further, and expanded stems with uniform expansion volume, brown color, modest and plain taste without obvious green gas and wood taste or offensive taste when combusted are acquired. Finally the expanded stems, free of offensive tastes, are sorted and packaged by different appearance and size, so final products of expanded stems are acquired.

After tobacco stems are expanded, the expansion volume, appearance and color vary, and the variations are more distinct if raw materials are of different origins, different batch and different quality. Especially, the color varies more significantly, from grey to dark brown, which is quite different from color of stem shreds. At this moment, if expanded stems are retained under hypoxia environment with heating temperature at 120~350° C. for 30 minutes to 20 hours, the color of expanded stems is made to turn brown, meanwhile odorant in stems is volatilized under the high temperature and brought out along with high-temperature gas, which lessens offensive tastes of stems and expands stems further. Major functions of the step of hypoxia heat retention are as follows: ① hardening tissue fibers in stems so that the expanded tissue cells and fibers do not shrink after cooling; ② expediting volatilization and decomposition process of odor components in expanded stems (through this step, stem color naturally turns brown and uniform). If this step is bypassed, part of expanded stems will shrink severely when they are cooled down, so the expansion ratio is not ideal and the content of odorant substances in stems is high; and green gas and offensive taste when combusted will impact original taste of cigarettes.

Major causes that impact stem color variation are stem quality, and origins. For example, huge difference in color exists between burley stems and flue-cured stems. But, Maillard reaction can make the tobacco stems have consistent color. Under the natural environment, white tobacco stems turn dark brown through the Maillard reaction. The process will take a long time and be affected by many external factors (the temperature, humidity, stacking thickness, etc.), which lead to that Maillard reaction intensity differs and color is different.

High-temperature air is utilized in the hypoxia heating process to treat expanded stems of different origins, different quality and color for certain time period, and then the Mailard reaction is performed on stems with substantially uniform intensity, so as to acquire uniform and brown stem.

After being stacked under natural environment for certain time period, odorant in stems is volatilized so as to acquire final products of expanded stems. Major function of the step of natural stacking is for releasing, volatilizing and decomposing odorant in stems further. If this step is bypassed, part of odorant will still remain in the expanded stems (the major odorant remained inside the expanded stem tissue is the gas which is released during hypoxia heat retention). Another function is that, the stems after the stacking process is with advantages, such as, of requiring less conditioning process time, no shrink after conditioning, good workability and higher filling power, compared with stems without the stacking process. The filling power of expanded stems without the stacking process is generally under 5, and the one after the stacking process can be controlled between 6 and 9.

Advantageous Effects

The preparation method according to the present invention and the expanded stems prepared by the same have the following advantages:

i. modest, plain organ sensory, without obvious raw offensive taste of stems like green gas and wood taste when combusted;
ii. the uniform expansion volume, the consistent ratio of expanded stems to the total feeding stems;
iii. uniform and brown color;
iv. an uniform appearance and size standard, wherein expanded stems are able to be made from raw stems of different origins, different batches and different quality, and odoriferous elements tends to be identical when combusted.
v. being available to be traded as a commercial product, wherein cigarette fillers like "stem shreds", "stem shives" and "stem strips" are able to be made from expanded stems by a cigarette manufacturer with their current equipments which are simply modified.
vi. cigarette fillers, made from expanded stems, not impacting the original organ sensory and taste of the cigarette blend due to their modest and plain taste.

EMBODIMENTS

The following embodiments 1-3 use the method below: eliminating foreign materials like scrap iron, dirt, dust and sand from stem; utilizing microwave or super-heated steam to expand stems until the volume is more than 180% of the original volume; further utilizing super-heated steam at the temperature of 120~350° C. or inert gas to heat the stems for 30 minutes to 20 hours; stacking the stems under natural environment (shady, ventilated, rain-proof, moisture proof) for 10 days to 3 months, then sorting the stems by size so as to acquire expanded stems. The expanded stems are brown, with uniform expansion volume, and there is no obvious green gas and wood taste which raw stems have when combusted.

Example 1

It includes the steps: eliminating foreign materials, such as scrap iron, dirt, dust and sand from stems planted in Yunnan province; utilizing microwave medium to expand stems to obtain the volume as 195% of the original volume, with the expanded stems accounting for 98% of the total feeding stems, and then utilizing super-heated steam at 120° C. under hypoxia environment for heating and keeping insulation for 20 hours; casing and stacking the stems under shady, ventilated, rain-proof and moisture-proof natural environment, for 10 days; and then sorting and packaging the stems by appearance and size, wherein they are classified as large, medium, and small types, so as to acquire final products of expanded stems. The color of final products is brown, with uniform expansion volume, and with no obvious green gas and wood taste when combusted.

Example 2

It includes the steps: eliminating foreign materials, such as scrap iron, dirt, dust and sand from burley stem; utilizing super-heated steam to expand stems to obtain the volume as 180% of the original volume, with the expanded stems accounting for 95% of the total feeding stem; and then utilizing super-heated steam at 350° C. under hypoxia environment for heating and keeping insulation for 30 minutes; bagging and stacking the stems under shady, ventilated, rain-proof and moisture-proof natural environment, for 3 months; then sorting and packaging the stems by appearance and size, wherein they are classified as large, medium, and small types, so as to acquire final products of expanded stems. The color of final products is brown, with uniform expansion volume, and with no obvious green gas and wood taste when combusted.

Example 3

It includes the steps: eliminate foreign materials, such as scrap iron, dirt, dust and sand from stems planted in Liangshan Mountain, Sichuan Province; utilizing microwave medium and super-heated steam to expand stems respectively to obtain the volume as 188% and 192% of the original volume, with the expanded stems accounting for 92% and 94% of the total feeding stems, and then treating the expanded stems obtained by the two method, by means of utilizing super-heated steam at 200° C. under hypoxia environment for heating and keeping insulation for 5 hours; casing and stacking stems under shady, ventilated, rain-proof and moisture-proof natural environment, for 1 month; then sorting and packaging stems by appearance and size, wherein they are classified as large, medium, and small types, so as to acquire final products of expanded stems, with the expansion volume of 195% and the expanded stems accounting for 98% of the total feeding stems. The color of final products is brown, with uniform expansion volume, and with no obvious green gas and wood taste when combusted.

Example 4

The expanded stems of Example 1 are cut into stem shives. It includes the steps: re-moisturizing the expanded stems until the re-moisturized stems have 25-35 wt % moisture, and storing them for 2 hours for conditioning moisture; feeding the expanded stems into a cutter for being cut, and then performing the screening process to acquire shives with diameter of 1-2.5 mm; finally utilizing hot air to dry the stem shives until they have moisture of 12.5 wt %, to acquire final products of stem shives. Color of final products is uniform and brown, without obvious offensive taste; and no impact was found to original flavor and taste of cigarettes when it was introduced in cigarette blend.

Example 5

The expanded stems of Example 2 are cut into stem strips. It includes the steps of: re-moisturizing the expanded stems until the re-moisturized expanded stems have moisture of 25-35 wt % and storing them for 2 hours for conditioning moisture; utilizing a stem cutter to cut the stems into strips with the size of 1~2 mm×1~2 mm, then utilizing microwave to dry them to the degree that the strips have the moisture of 12.5% wt to acquire stem strips. The color of final products is uniform and brown, without obvious offensive taste; no impact was found to original flavor and taste of cigarette when it was introduced in cigarette blend.

Example 6

The expanded stems of Example 3 are made to traditional cut stems. It includes the steps of: re-moisturizing the expanded stems until the re-moisturized expanded stems have moisture of 25-35 wt % and storing them for 2 hours for conditioning moisture; utilizing a stem cutter to cut the expanded stems into slices with thickness of 0.1~0.3 mm, then utilizing hot air to dry them to the degree that the slices have the moisture of 12.5% wt to acquire traditional cut stems. The color of final products is uniform and brown, without obvious offensive taste; no impact was found to original style and taste of cigarette when it was introduced in cigarette blend.

As shown in FIG. 1, huge difference on color and appearance can be found between the expanded stems according to the present invention and traditional an expanded stem product. Major color variation from grey to dark brown can be found on the expanded stem product obtained by the traditional method (shown in FIG. 1, *a*), while the expanded stem product in Example 1-3 of the present invention are with uniform and brown color.

Figure 2:
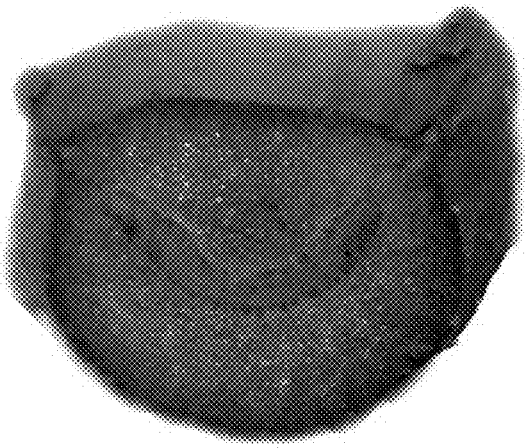
FIG. 2 is a cross section view of an expanded stem.

As shown in FIG. 2, from the cross section of the expanded stem of Example 1-3, it can be observed that the inside and outside of the expanded stem are brown: there is a dark brown ring on the epidermis and its core also is brown.

Figure 3:
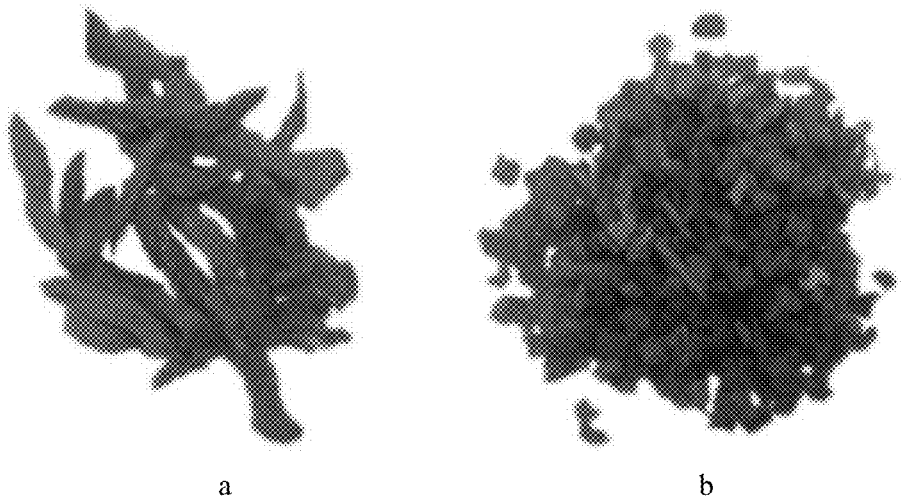
FIG. 3 is a profile view of stem shreds and shives made from expanded stems.

As shown in FIG. 3, through simple rebuilding the current equipment in a cigarette manufacturer such as rebuilding the stem cutter, expanded stems can be easily produced into stem strips (shown in FIG. 3, *a*); by utilizing a traditional stem cutter, and stem shives product can be easily produced.

Figure 4:
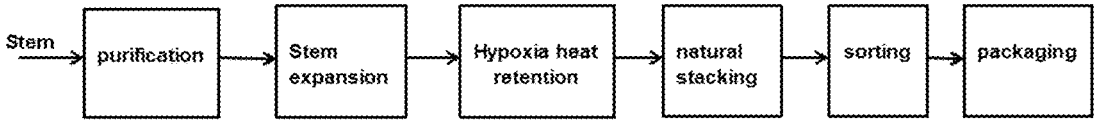
FIG. 4 is a flow chart of the method for expanded stems of the present invention.

As shown in FIG. 4, the method for preparing expanded stems contains steps as follows:

g. purification: wherein foreign materials such as scrap iron, dirt, dust and sand in tobacco stem are eliminated;
h. stem expansion: wherein the stems are expanded to the degree that the volume is 180% of the original volume;
i. hypoxia heat retention, wherein the expanded stems are heated to 120~350° C. under hypoxia environment and the temperature is maintained;
j. natural stacking: wherein the expanded stems after the hypoxia heat retention are stacked under natural environment for 10 days to 3 months;
k. sorting, wherein the expanded stems are sorted by different size;
l. packaging, wherein the sorted tobacco stems are packaged by different size, so as to acquire final products of expanded stems.

The invention claimed is:

1. An expanded tobacco stem prepared by a method comprising a. purification, wherein impurities in the stems are eliminated;
b. stem expansion, wherein the stems are expanded until volume of the stems is more than 180% of the original volume;
c. hypoxia heat retention, wherein the expanded stems are heated to the temperature of 120-350° C., under hypoxia environment and the temperature is maintained, to harden tissue fibers and expedite volatilization and decomposition process of odor components in stems, wherein heat-preservation time is from 30 minutes to 20 hours;
d. natural stacking, wherein the expanded stems after the hypoxia heat retention are stacked under natural environment for 10 days to 3 months, to facilitate further release, volatilization and decomposition of odorant in the stems and improve filling power of the stems;
e. sorting, wherein the expanded stems are sorted by different size;
g. packaging, wherein the sorted expanded stems are categorized and packaged by different size separately, resulting in a final product of expanded stem characterized in that when combusted it has modest and plain taste, without distinct green gas and wood taste that a tobacco stem originally has, with uniform brown color, and consistent expansion volume.

2. The expanded tobacco stem of claim 1 characterized in that the final product of expanded stems can be produced into stem fillers for cigarette.

3. The expanded tobacco stem of claim 1 characterized in that in the step of hypoxia heating retention, inert gas or super-heated steam at temperature of 120-350° C. is utilized for heating and thermal insulation.

4. The expanded tobacco stem of claim 1 characterized in that in the step of hypoxia heating retention, the heat-preservation time is from 3 hours to 15 hours.

5. The expanded tobacco stem of claim 1 characterized in that in the step of natural stacking, the final product of expanded stems is cased or bagged and then stacked in shady, cool, ventilated, rain-proof, and moisture-proof environment for 10 days to 3 months.

6. The expanded tobacco stem of claim 1 characterized in that in the step of stacking, the final product of expanded stems is cased or bagged and then stacked in shady, cool, ventilated, rain-proof, and moisture-proof environment for 25 days to 3 months.

7. The expanded tobacco stem of claim 1 characterized in that in the step of sorting, the expanded stem are sorted and categorized by appearance and size.

* * * * *